US005399931A

United States Patent [19]

Roberts

[11] Patent Number: 5,399,931

[45] Date of Patent: Mar. 21, 1995

[54] TWO KILOWATT SHORT ARC LAMP HAVING A METAL HEAT-TRANSFER PAD

[75] Inventor: Roy D. Roberts, Newark, Calif.

[73] Assignee: ILC Technology, Inc., Sunnyvale, Calif.

[21] Appl. No.: 9,926

[22] Filed: Jan. 27, 1993

[51] Int. Cl.[6] ..... H01J 1/02

[52] U.S. Cl. ..... 313/46; 313/39; 313/110; 313/111; 313/246; 313/113; 313/570; 313/634; 313/355; 313/631; 313/632

[58] Field of Search ..... 313/46, 39, 110, 111, 313/246, 113, 570, 634, 355, 631, 632

[56] References Cited

U.S. PATENT DOCUMENTS

| | | | |
|---|---|---|---|
| 1,515,866 | 6/1922 | Martin et al. | 313/141 |
| 3,657,588 | 4/1972 | McRae | 313/113 |
| 3,731,133 | 5/1973 | McRae et al. | 313/113 |
| 3,808,496 | 4/1974 | McRae et al. | 313/113 |
| 4,633,128 | 12/1986 | Roberts et al. | 313/113 |
| 4,724,352 | 2/1988 | Schuda et al. | 313/113 |
| 4,785,216 | 11/1988 | Roberts et al. | 313/39 |

*Primary Examiner*—Sandra L. O'Shea
*Assistant Examiner*—Ali Horri
*Attorney, Agent, or Firm*—Thomas E. Schatzel

[57] ABSTRACT

An embodiment of the present invention is a short arc lamp comprising an alumina ceramic cylindrically shaped body with a concave opening at one end that is silvered to form a reflector, a cathode suspended within the concave opening in opposition to an anode that protrudes through a hole in the center of the concave opening from the opposite end of the body, a circular iron base that supports the anode at its center and attaches to the body with a metal ring that bridges a separation between the base and the body, and a copper heat transfer pad that is brazed to the inside of the metal ring and the body such that heat is efficiently transferred from the area of the concave reflector near the hole for the anode to a heat sink that attaches to the metal ring outside the lamp. A copper plug brazed as an integral part of the anode serves to distribute heat efficiently throughout the anode.

2 Claims, 1 Drawing Sheet

TWO KILOWATT SHORT ARC LAMP HAVING A METAL HEAT-TRANSFER PAD

BACKGROUND OF THE INVENTION

1. Field of the Invention

The invention relates generally to arc lamps and specifically to lamps with short arcs capable of operating at two kilowatts.

2. Description of the Prior Art

Short arc lamps provide intense point sources of light that allow light collection in reflectors for applications in medical endoscopes, instrumentation and projection. Short arc lamps are used in industrial endoscopes for the inspection of jet engine interiors.

A typical short arc lamp comprises an anode and a cathode positioned along the longitudinal axis of a cylindrical, sealed concave chamber that contains a gas pressurized to several atmospheres. U.S. Pat. No. 4,633,128, issued Dec. 30, 1986, to Roy D. Roberts, the present inventor, and Robert L, Minor, describes such a short arc lamp in which a copper sleeve member is attached to the reflecting wall to conduct heat from the reflecting wall through to the exterior wall and eventually to circulating ambient air.

The lamp illustrated in FIG. 2 of Roberts, et at., can be operated at one kilowatt. At higher power levels, the heat generated by an electric arc between cathode 94 and anode 100 encounters too much thermal resistance to the ambient and the lamp can overheat and fail. Specifically, applying too much power to the lamp creates thermal gradients in the ceramic material that will cause cracks in the body and possibly an explosion of a weakened lamp.

FIG. 1 illustrates a prior art short arc lamp 10. The lamp 10 comprises a cathode 12, a cathode suspension strut 13, an anode 14, a reflecting concave wall 16 in a ceramic alumina body 18, a window 20, metallic base 22, a first metal band 24, a second metal band 26 and a copper heat-transfer pad 28. In operation, an electric arc 30 bridges the gap between cathode 12 and anode 14. Base 22 is typically comprised of iron and functions to electrically connect anode 14 to first metal band 24. Heat generated by electric arc 30 is conducted away by passing through body 18, especially wall 16 near anode 14 to copper heat-transfer pad 28 and again through body 18 to first metal band 24. An air fin heat sink, not shown, slips over and tightly around first metal band 24 to provide heat sinking to circulating forced air. A second heat path is through anode 14 and rear of base 22 and to first metal band 24.

A more efficient transfer of heat is therefore needed to operate short arc lamps at power levels of two kilowatts.

SUMMARY OF THE PRESENT INVENTION

It is therefore an object of the present invention to provide a short arc lamp capable of operating at two kilowatts.

Briefly, an embodiment of the present invention is a short arc lamp comprising an alumina ceramic cylindrically shaped body with a concave opening at one end that is silvered to form a reflector, a cathode suspended within the concave opening in opposition to an anode that protrudes through a hole in the center of the concave opening from the opposite end of the body, a circular iron base that supports the anode at its center and attaches to the body with a metal ring that bridges a separation between the base and the body, and a copper heat transfer pad that is brazed to the inside of the metal ring and the body such that heat is efficiently transferred from the area of the concave reflector near the hole for the anode to a heat sink that attaches to the metal ring outside the lamp. A copper plug brazed as an integral part of the anode serves to distribute heat efficiently throughout the anode.

An advantage of the present invention is that a short arc lamp is provided that can operate at power levels of two kilowatts.

Another advantage of the present invention is that a two-kilowatt short arc lamp is provided that can have the same outside dimensions as prior art lamps capable of operating at much less power, e.g., only half as much power.

A further advantage of the present invention is that a high powered short arc lamp is provided that is economic to manufacture.

These and other objects and advantages of the present invention will no doubt become obvious to those of ordinary skill in the art after having read the following detailed description of the preferred embodiment which is illustrated in the various drawing figures.

IN THE DRAWINGS

FIG. 1 is a cross-sectional view taken along the central axis of a cylindrical prior art high intensity short arc lamp; and FIG. 2 is a cross-sectional view taken along the central axis of a cylindrical two kilowatt short arc lamp embodiment of the present invention.

DETAILED DESCRIPTION OF THE PREFERRED EMBODIMENTS

Figure 2:
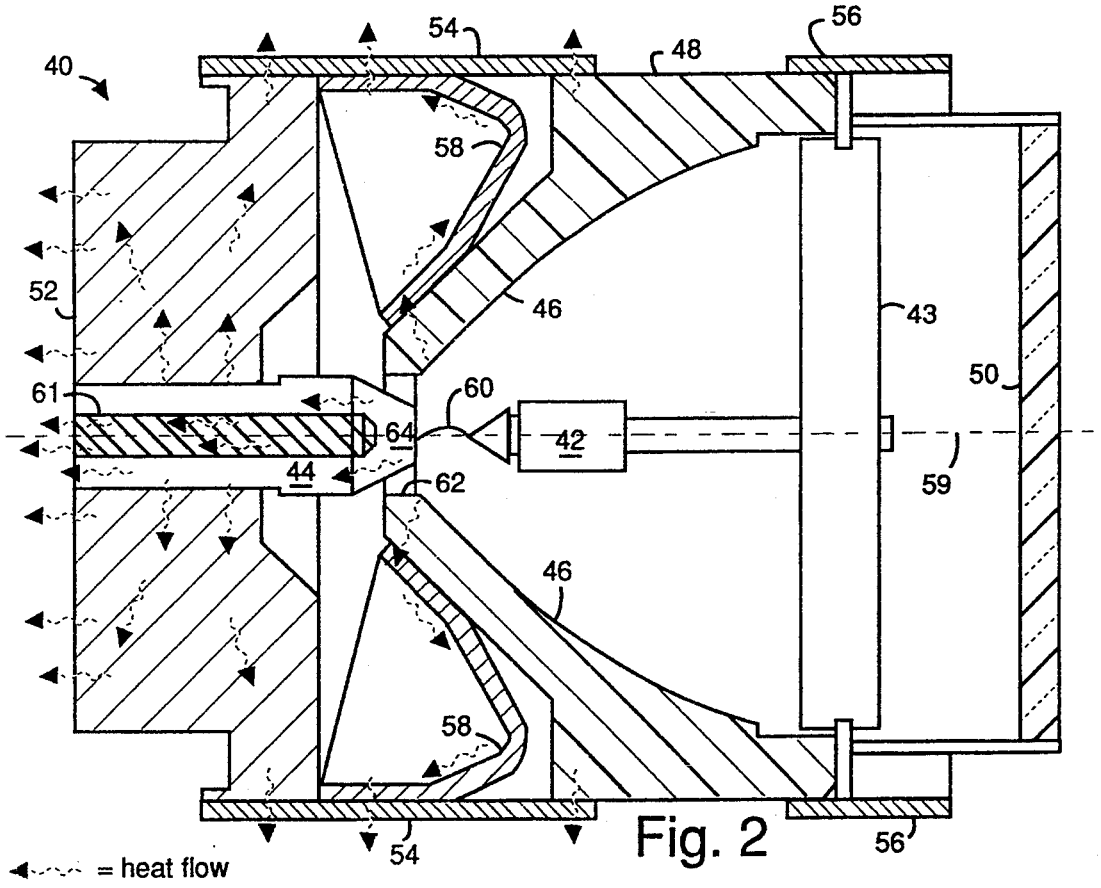

FIG. 2 illustrates a short arc lamp embodiment of the present invention, referred to herein by the general reference numeral 40. The lamp 40 comprises a cathode 42, a cathode suspension strut 43, an anode 44, a reflecting concave wall 46 in a ceramic alumina body 48, a window 50, a base 52, a first metal band 54, a second metal band 56 and a copper heat-transfer pad 58 brazed to body 48 behind wall 46 and to first metallic band 54. Reflecting concave wall 46 is symmetric about a longitudinal axis 59 of lamp 40, and may be parabolic, elliptical or aspherical to provide a highly collimated output light beam or a point focused light output. Reflecting concave wall 46 is typically silvered to provide a mirror finish.

Figure 1:
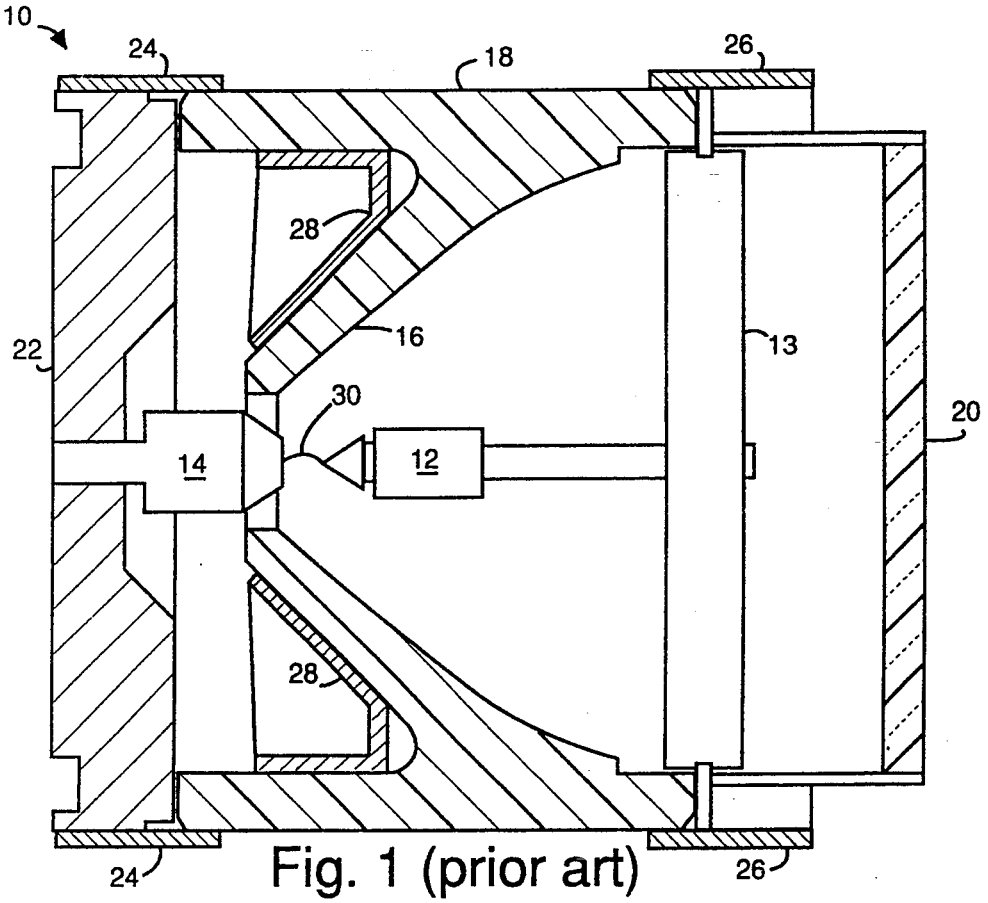
Fig. 1 (prior art)

In operation, an electric arc 60 bridges the gap between cathode 42 and anode 44. Radiation is generated that is generally more intense at a point along arc 60 near cathode 42. Heat generated by electric arc 60 is conducted away by passing the heat through body 48, especially wall 46 near anode 44 to copper heat-transfer pad 58 and directly to first metal band 54. The longitudinal length of first metal band 54 is substantially longer than that of the second metal band 56. The length of first metal band 54 bridges a gap between body 48 and base 52 that allows a direct attachment of heat-transfer pad 58 to first metal band 54. The heat is more efficiently transferred out of lamp 40 by avoiding a second passage through the material of body 48 which is typically not as heat conductive as metal, especially copper. (Prior art lamps, such as lamp 10, do require such a second passage through the ceramic body material.) An air fin heat sink, not shown, slips over and tightly around first metal band 54 to provide heat sinking to circulating forced air. A second heat path is through anode 44, which includes as a core, a copper plug 61, and base 52 to first metal band 54. Base 52 is sized much thicker than prior art supports (e.g., see FIG. 1) and is therefore able to conduct heat from anode 44 more effectively radially outward to sleeve 54 and downward to the rear of base 52. Anode 44 is also substantially more massive than anodes in prior art lamps, as exemplified by lamp 10 in FIG. 1. To create more volume for anode 44, the greatest outside diameter of anode 44 is as large or larger than the inside diameter of a hole 62 in reflective wall 46 through which anode 44 accesses cathode 42 to create arc 60. A conical section 64 is incorporated in anode 44 to allow anode 44 to protrude through hole 62 and yet not contact wall 46. The more massive bulk of anode 44, the substantially thicker base 52 and the direct connection of heat transfer pad 58 to first metal band 54 allow lamp 40 to operate at two kilowatts, provided an adequate air fin heat sink is attached to base 52 and first metal band 54 and there is sufficient forced-air cooling.

5 For a two-kilowatt implementation of lamp 40, body 48 may have a longitudinal length of 1.5 inches and an outside diameter of 2.25 inches. First metal band 54 would therefore have an inside diameter of approximately 2.25 inches and a longitudinal length of approximately 1.5 inches. A heat sink (not shown) attached to first metal band 54 preferably is sized to contact substantially all of the outside diameter surface of first metal band 54 to assure efficient heat transfer. Base 52, in such an example, would be at least 0.8 inches thick and have an outside diameter compatible with brazing to the inside diameter of first metal band 54. Gap 60 is typically greater than 0.020 inches and less than 0.150 inches. Lamp 40 is filled with a gas under pressure, such as xenon.

U.S. Pat. No. 4,633,128, issued to Roberts, et al., on Dec. 30, 1986, describes many details regarding construction of short arc lamps. Therefore, said patent is incorporated herein and made a part of this disclosure.

In view of the lamp 40 illustrated in FIG. 2, several alternative embodiments will be apparent to those skilled in the art. It would also be possible to fill the void between body 48 behind reflective wall 46 and base 52 with a copper solid that either brazes in or screws in to lower the thermal contact resistance. Base 52 may be comprised of copper, rather than iron, and heat transfer between anode 44 and base heat sink and first metal band 54 would thereby be improved. Heat-transfer pad 58 and first metal band 54 can be a single piece of metal in a casting, e.g., of copper. Heat-transfer pad 58 and first metal band 54 could also be a single piece casting with a radial air fin heatsink. Appropriate machining and casting of base 52, heat-transfer pad 58 and first metal band 54 could be used to support liquid coolant circulation.

The elimination in the present invention of the ceramic heat dissipation blockage that exists in prior art lamps, such as that part of body 18 (FIG. 1) between sleeve 24 and transfer pad 28, substantially improves the heat transfer from copper pad 58 (FIG. 2) to first metal band 54. The ceramic blockage is an impediment to good heat transfer because the ceramic material is a poor thermal conductor. The best results and higher power operation occur when the rate of heat transfer, such as between reflector wall 16 and metal sleeve 24, is maximized.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An improved short arc lamp (40) comprising a concave reflecting wall (46) with a convex-shaped spacing formed behind the concave wall and with the thickness of the reflecting wall portion near a focal point of the lamp being thinner than the thickness of the reflecting wall radially outward from said focal point and having a metallic sleeve member attached to the reflecting wall (46) within said convex-shaped spacing to conduct heat from the reflecting wall to an exterior wall of the lamp, the improvement comprising:

a base (52) with an anode (44) positioned within the base and coaxial with said focal point;

a insulative reflector body (48) coaxial with said anode and positioned coaxially about said focal point of said lamp with said thinner portion of the reflecting wall (46) near said focal point of said lamp extending axially further toward the base (52) than does an outside perimeter wall of said reflector body (48);

a solid metal ring (54) coaxial with the base (52) and the reflector body (48) and sealingly attached between the base (52) and the reflector body (48) part of the outside circumferential surface of said lamp, having an inner surface exposed to said convex-shaped spacing; and a metal heat-transfer pad (58) attached at an outside perimeter with a fold to an inside surface of the solid metal ring (54) away from the reflector body (68) and attached at an inside perimeter within said fold to said thinner portion of said reflecting wall (46) within said convex-shaped spacing, wherein the solid metal ring (54) and the heat-transfer pad (58) form an all-metal pathway from said thinner portion of the body (48) to said outside of the solid metal ring (54) to conduct away heat generated in said reflecting wall (46).

2. The lamp of claim 1, wherein:

the anode includes a core comprising a copper plug provided for distributing heat throughout the anode during operation of the lamp.

* * * * *